United States Patent [19]

Smagula

[11] Patent Number: 4,874,100

[45] Date of Patent: Oct. 17, 1989

[54] BELT HOLDER

[76] Inventor: Billie T. Smagula, 403 Balboa Dr., Universal City, Tex. 78148

[21] Appl. No.: 280,239

[22] Filed: Dec. 5, 1988

[51] Int. Cl.[4] ..... A47F 7/00

[52] U.S. Cl. ..... 211/60.1; 211/13; 211/70.1; 211/113

[58] Field of Search ..... 211/117, 118, 60.1, 211/70.1, 13, 113

[56] References Cited

U.S. PATENT DOCUMENTS

| | | | |
|---|---|---|---|
| 2,622,743 | 12/1952 | Ross | 211/59.1 X |
| 2,951,589 | 9/1960 | Dudley | 211/59.1 |
| 3,028,013 | 4/1962 | Cotey . | |
| 3,081,881 | 3/1963 | Seeger . | |
| 3,592,343 | 7/1971 | Swett | 211/113 X |
| 3,718,260 | 2/1973 | Sharp | 211/13 |
| 3,777,894 | 12/1973 | Swenson . | |
| 4,109,794 | 8/1978 | Samuel et al. . | |
| 4,428,486 | 1/1984 | Collins | 211/59.1 X |
| 4,768,657 | 9/1988 | Lonow | 211/113 X |

*Primary Examiner*—Robert W. Gibson, Jr.
*Attorney, Agent, or Firm*—Henderson & Sturm

[57] ABSTRACT

A belt holder having a first and a second rigid plate rigidly connected together. Narrow slots are disposed in the first rigid plate and wider slots, aligned with the slots in the first rigid plate, are disposed in the second rigid plate for allowing belts to extend through the narrow slots in the first rigid plate and having the buckle of such belt being disposed at least partially between the first and second rigid plates and within one of the elongated slots in the second rigid plate.

7 Claims, 2 Drawing Sheets

BELT HOLDER

TECHNICAL FIELD

The present invention relates generally to belt holders and more particularly to a belt holder which will hold any kind of belt, which will hold a plurality of belts and which is adapted to hang from a clothes closet bar.

BACKGROUND ART

Most people have a plurality of belts. Such belts are normally of various and numerous sizes, shapes, colors and configurations. A common problem is how to store such belts. If the belts are merely placed in a drawer or the like, they take up more room than is necessary and such storage can permanently disfigure a belt if it is folded in the wrong position for a prolonged period of time.

It is generally considered that the best way to store belts is to hang them up both from the standpoint of saving space and from the standpoint of maintaining them in their best condition.

U.S. Pat. No. 3,028,013 to Cotey shows a belt holder but it will be readily be appreciated that it is not completely universal from the standpoint of holding belts of different widths for holding fashion buckle belts or belts without buckles and for holding belts having buckles with no prongs thereon.

DISCLOSURE OF THE INVENTION

The present invention relates generally to a belt holder having a first and a second rigid plate rigidly connected together. Narrow slots are disposed in the first rigid plate and wider slots, aligned with the slots in the first rigid plate, are disposed in the second rigid plate for allowing belts to extend through the narrow slots in the first rigid plate and having the buckle of such belt being disposed at least partially between the first and second rigid plates and within the elongated slots in the second rigid plate.

An object of the present invention is to provide an improved belt holder.

A further object of the present invention is to provide a belt holder which will hold a plurality of belts.

Another object of the present invention is to provide a belt holder which is universal enough to hold belts of various shapes and sizes including belts of different widths, belts with fashion buckles, belts without buckles and belts having buckles with no prongs thereon, for example.

Other objects, advantages, and novel features of the present invention will become apparent from the following detailed description of the invention when considered in conjunction with the accompanying drawings.

BEST MODE FOR CARRYING OUT THE INVENTION

Figure 1:
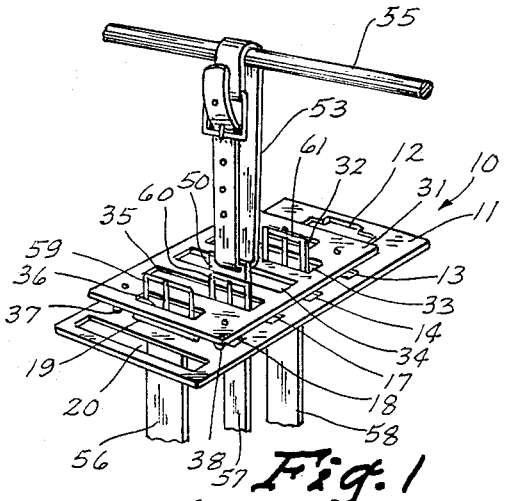
FIG. 1 is a perspective view of a preferred embodiment of the present invention hung so that first and second rigid plates are disposed in a horizontal orientation.
Figure 4:
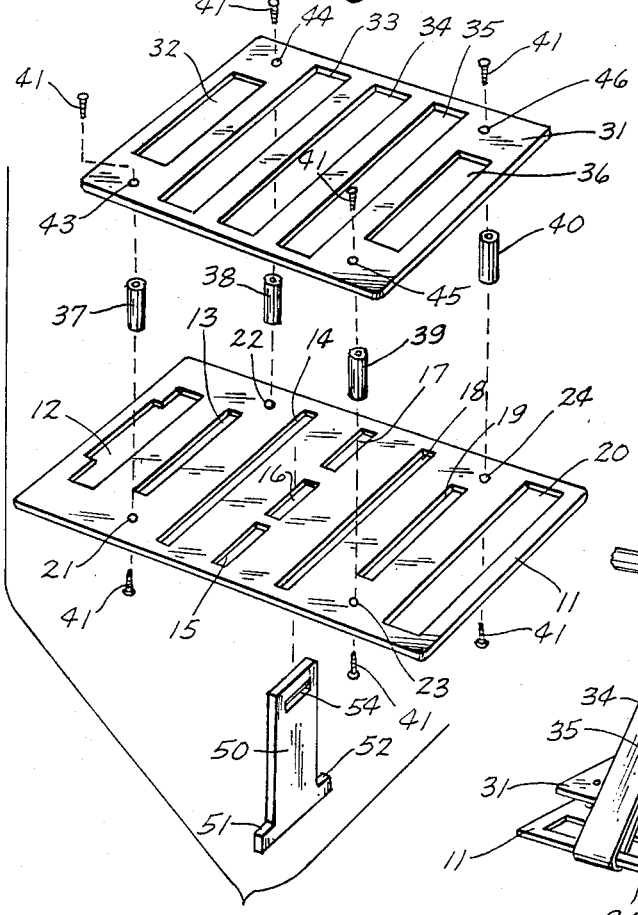
FIG. 4 is an enlarged exploded perspective view of the preferred embodiment of the invention.

Referring now to the drawings wherein like reference numerals designate identical or corresponding parts throughout the several views, FIG. 1 shows a belt holder (10) constructed in accordance with the present invention. Referring to FIG. 4, it is noted that a first rigid plate (11) has a plurality of elongated slots (12), (13), (14), (15), (16), (17), (18), (19), and (20) disposed therethrough. Additionally the rigid plate (11) has a plurality of openings (21), (22), (23) and (24) extending therethrough.

A second rigid plate (31) has a plurality of elongated slots (32), (33), (34), (35) and (36) therein all of which are wider than the slots in which they are aligned with in the first rigid plate (11). These rigid plates (11) and (31) can be made of many different materials, such as wood, metal or plastic.

Four posts (37), (38), (39) and (40) are threaded on each end thereof so that threaded fasteners (41) can extend through openings (21–24) in the first plate (11) and threadably engage the bottom of the post (37–40). Other threaded fasteners (41) can extend through openings (43), (44), (45) and (46) and threadably engage the top of the posts (37–40) to thereby form a rigid structure to hold the first and second plates (11) and (31) in a spaced apart rigid relationship with respect to each other so as to maintain the first and second rigid plates (11) and (31) parallel to one another and to hold the slots of the plates in a proper relationship with respect to each other.

In operation, when it is desired to hang the belt holder (10) in the position shown in FIG. 1, a member (50) having extension parts (51) and (52) extend up through the opening (16). Because the length of the bottom of the member (50) is longer than the slot (16), the top edges of members (51) and (52) will impinge upon the bottom of the first rigid plate (11).

A belt (53) is shown extending through a slot (54) in the top of the member (50) and over a clothes hanging bar (55) in a closet or the like. This arrangement will hold the belt holder (10) in the position shown in FIG. 1 wherein the first and second plates (11) and (31) are held in a substantially horizontal position. In these circumstances, belts (56), (57) and (58) having buckles (59), (60) and (61) thereon can be easily stored by inserting such belts along the top through the slots in the plates (11) and (31). For example, the belt (56) extends through opening (19) in the first plate (11) and buckle (59) is held in the slot (36), the buckle (59) being too big to pass through the slot (19). Similarly, the belt (57) extends through slot (18) in the plate (11) and the buckle is too big to extend through (18) and therefore the buckle (60) is held in the slot (35) in plate (31).

Figure 3:
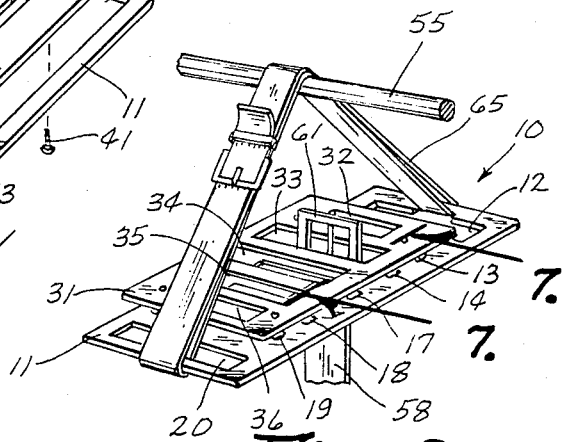
FIG. 3 shows an alternate way to hang the belt holder so that the first and second rigid plates are in a horizontal orientation.
Figure 5:
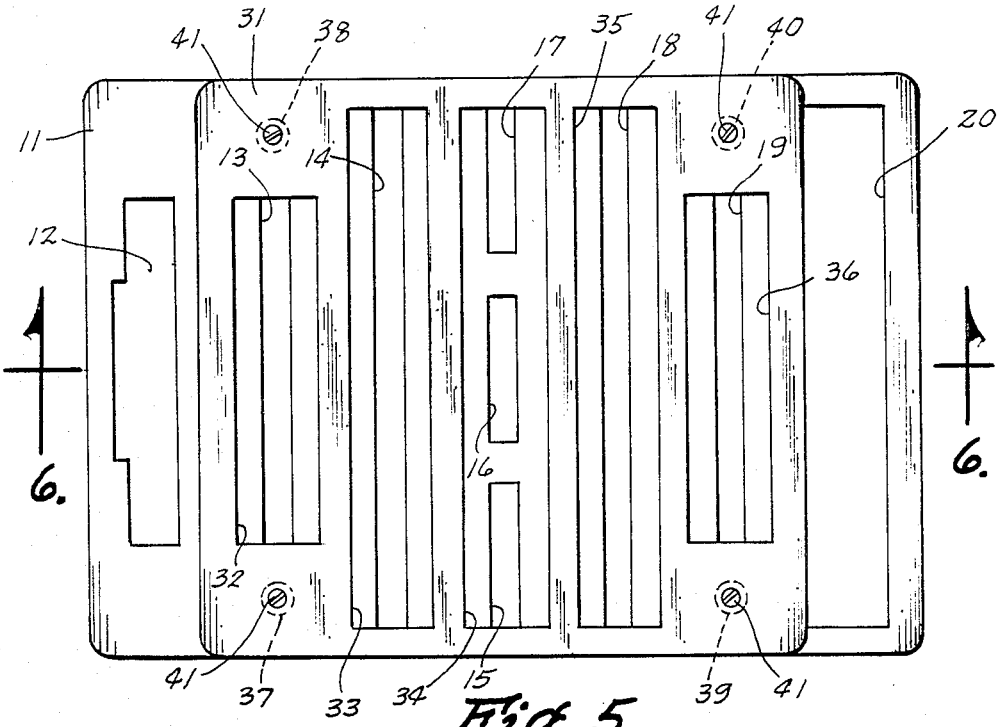
FIG. 5 is a top view of the preferred embodiment of the present invention.
Figure 6:
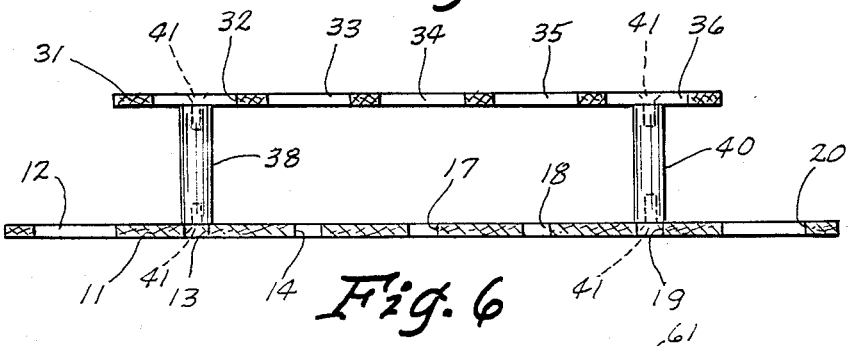
FIG. 6 is a cross-sectional view taken along line 6—6 of FIG. 5.
Figure 7:
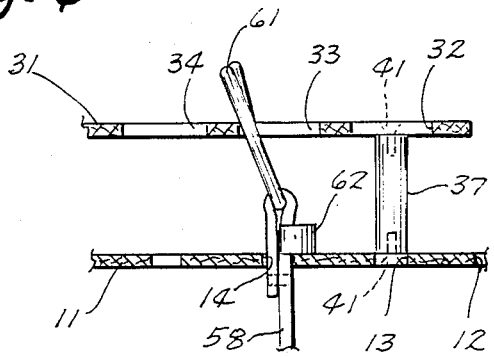
FIG. 7 is an enlarged partial cross-sectional view taken along line 7—7 of FIG. 3.

Similarly, the belt (58) extends through slot (14) as can readily be seen in FIGS. 1, 3 and 7 and a belt loop (62) prevents the belt (58) from passing down through the opening (14), while at the same time the belt buckle (61) is disposed between the first and second rigid plates

(11) and (31) and is held in the slot (33) in the rigid plate (31).

Referring to FIG. 3, it is noted that the apparatus (10) is essentially the same except that the member (50) is not used, instead, a belt (65) is extended over the bar (55) to hold the plates (11) and (31) in horizontal position. Only the belt (58) and buckle (61) are shown in FIGS. 3 and 7, although it will be understood that other belts and buckles can extend through the other slots in the plates (11) and (31).

Figure 2:
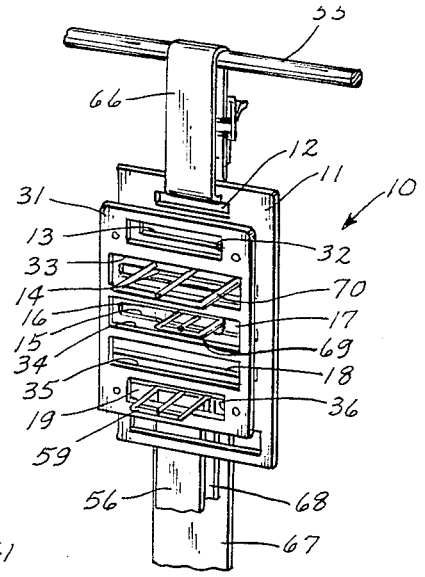
FIG. 2 is the preferred shown in FIG. 1 but being hung from a clothes bar in a hanger so that the first and second plates are in a vertical orientation.

Referring to FIG. 2, it is noted that the belt holder (10) can be suspended so that the plates (11) and (31) are oriented in a vertical fashion by using a belt (66) extending through slot (12) in the plate (11), which belt (66) extends over the clothes closet bar (55). In such orientation, the belt (56) extends through slot (19) in plate (11) and through slot (36) in plate (31). The buckle (59) is thereby held in the slot (36). Similarly, belt (68) extends through slot (16) in plate (11) and is held in slot (33) in plate (31). The wider belt (67) extends through slot (14) in plate (11) and the buckle (70) is disposed in the slot (33) in FIG. 2.

Accordingly it will be appreciated that the preferred embodiment shown above does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A belt holder comprising:

a first rigid plate having a first elongated slot disposed therethrough;

a second rigid plate spaced from and rigidly affixed to said first rigid plate, a second elongated slot disposed therethrough, said second elongated slot being generally aligned with but larger than said first elongated slot in the first rigid plate;

means for attaching at least one of said first and second plates to a clothes closet bar whereby said belt holder is suspended therefrom; and a flexible belt having a buckle attached to one end, said belt extending through said first slot and said buckle being disposed at least partially between the first and second rigid plates and within said second elongated slot, said one end of said belt having said buckle attached thereto being too large to pass through said first slot and whereby the other end of said belt hangs downwardly from said first rigid plate.

2. The belt holder of claim 1 wherein said first rigid plate has a third elongated slot disposed therein and said second rigid plate has a fourth elongated slot disposed therein, said third and fourth slots being for holding additional belts.

3. The belt holder of claim 2 including additional pairs of aligned slots in said first and second rigid plates for receivably holding additional belts.

4. The belt holder of claim 1 wherein said attaching means comprises a holder slot in one end of said first rigid plate and a holder belt disposed through said holder slot, said holder belt being adapted to be connected to a clothes bar in a closet.

5. The belt holder of claim 1 wherein said attaching means includes:

a first holder slot in a central portion of said first rigid plate;

a member extending through said holder slot, said member being too large on one end thereof to pass through said holder slot, a second holder slot in the other end of said member, said member also extending through said second elongated slot; and a belt extending through said second holder slot and around said clothes closet bar for holding said first and second rigid plates in a generally horizontal position.

6. The belt holder of claim 1 including means for holding the first and second plates in a spaced apart parallel position with respect to each other.

7. The belt holder of claim 6 wherein said holding means comprises a rigid post attached at one end thereof adjacent to each corner of said second rigid plate and at the other end thereof to said first rigid plate.

* * * * *